US008236403B2

(12) United States Patent
Silver

(10) Patent No.: US 8,236,403 B2
(45) Date of Patent: Aug. 7, 2012

(54) MULTIPLE FACE FABRIC TOWEL

(76) Inventor: Scott H. Silver, Annapolis, MD (US)

( * ) Notice: Subject to any disclaimer, the term of this patent is extended or adjusted under 35 U.S.C. 154(b) by 935 days.

(21) Appl. No.: 11/383,889

(22) Filed: May 17, 2006

(65) Prior Publication Data

US 2007/0269630 A1 Nov. 22, 2007

(51) Int. Cl.
*D03D 27/08* (2006.01)
*B32B 33/00* (2006.01)

(52) U.S. Cl. ..... 428/89; 428/88; 428/92; 428/97; 139/396; 139/391; 139/2

(58) Field of Classification Search ..... 428/97, 428/88, 89, 92; 139/391, 396
See application file for complete search history.

(56) References Cited

U.S. PATENT DOCUMENTS

| | | | | |
|---|---|---|---|---|
| 5,486,500 | A | 1/1996 | Kaufman | |
| 6,247,505 | B1 | 6/2001 | Worman | |
| 6,774,067 | B2 * | 8/2004 | Demott et al. | 442/312 |
| 2001/0023157 | A1 * | 9/2001 | Sheppard, Jr. | 442/203 |
| 2001/0031591 | A1 * | 10/2001 | Sheppard, Jr. | 442/203 |
| 2002/0011169 | A1 * | 1/2002 | Sheppard, Jr. | 101/484 |
| 2003/0131901 | A1 * | 7/2003 | Sheppard, Jr. | 139/416 |
| 2004/0055659 | A1 * | 3/2004 | Silver | 139/396 |
| 2004/0224121 | A1 * | 11/2004 | Sheppard | 428/92 |
| 2005/0239361 | A1 * | 10/2005 | Fay et al. | 442/246 |
| 2008/0022435 | A1 * | 1/2008 | Silver | 2/158 |

* cited by examiner

*Primary Examiner* — Cheryl Juska
(74) *Attorney, Agent, or Firm* — Laubscher & Laubscher, P.C.

(57) ABSTRACT

A versatile fabric for use as a towel includes multiple surface areas that are formed of different materials. A support web has hydrophilic and hydrophobic materials woven therethrough. The hydrophilic material is interlaced with the web to define loops of material which extend from a first portion of the web surface and loops of material which extend from a second portion of the web surface which is longitudinally spaced from the first portion. Similarly, the hydrophobic material is interlaced with the web to define loops of material which extend from a third portion of the web surface and loops of material which extend from a fourth portion of the web surface which is longitudinally spaced from the third portion. The first and third portions of the support web surface are arranged opposite each other and the second and fourth portions of the support web surface are arranged opposite each other to define four surface portions of the fabric.

8 Claims, 2 Drawing Sheets

MULTIPLE FACE FABRIC TOWEL

BACKGROUND OF THE INVENTION

Fabric towels have many uses including drying people or objects, scrubbing, and wiping surfaces. Most fabric towels have a terry or velour finish which contributes to the intended use of the towel. In addition, because towels are often displayed, they include a decorative component as well. The decorative component may be the result of simply dying yarn used to weave the towel, weaving the towel with a decorative texture owing to the size of the loops on the surface of the towel, or may be more complex including printing or silk-screening pictures or other designs on a towel surface.

The present invention relates to a unique fabric towel which has distinct surface portions which enable the towel to perform different functions.

BRIEF DESCRIPTION OF THE PRIOR ART

Multi-function towels and methods for making the same are well-known in the patented prior art as evidenced by the U.S. patents to Kaufman U.S. Pat. No. 5,486,500 and Worman U.S. Pat. No. 6,247,505. The Kaufman patent discloses a towel having two faces. One face is a print receiving face formed primarily of non-absorbent material and the other face, which is arranged on the opposite surface of the towel, is an absorbent face formed of absorbent material such as cotton. The Worman patent discloses a terry or velour fabric in which cotton loops are formed on one surface of a support strip and microfiber loops are formed on the opposite surface of the support strip so that the fabric has different materials on opposite sides thereof.

While the prior fabrics normally operate satisfactorily, they are limited to the number of different surface portions that are provided. This in turn limits the uses for which a fabric formed according to the prior art may be used. The present invention was developed in order to overcome these and other drawbacks by providing a towel with more than two distinct surface areas to perform different functions.

SUMMARY OF THE INVENTION

The multi-surface fabric according to the invention includes a support web having a plurality of picks and plurality of warps crossly wrapped around at least one of the picks. The web has first and second surfaces on opposite sides of the web. A hydrophilic material is interlaced in the support web to define loops of material which extend from a first portion of the first surface of the support web and from a second portion of the second surface of the support web. The first and second portions bearing loops of hydrophilic material are longitudinally spaced from each other. A hydrophobic material is interlaced in the support web to define loops of material which extend from a third portion of the first surface of the support web and from a fourth portion of the second surface of the support web. The third and fourth portions bearing loops of hydrophobic material are also longitudinally spaced from each other. The first and third portions of the support web are arranged opposite to one another and the second and fourth portions of the support web are arranged opposite to one another to define four distinct surface portions of the fabric.

The hydrophobic material preferably comprises polyester, nylon, acrylic or microfiber yarn and the hydrophilic material preferably comprises cellulosic or cotton yarn. Thus, each surface of the web includes a moisture absorbing portion and moisture repelling portion, with the absorbing and repelling portions being arranged in back-to-back relation on opposite sides of the web.

A decorative pattern can be printed or otherwise embellished on at least one of the hydrophobic portions of the fabric and any of the portions can be woven to form a ribbed or sculptured construction by providing loops of different heights. In addition, any of the surface portions may also have their loops sheared to define a velour fabric on the sheared portion.

The invention further relates to a method for making the multi-face fabric as set forth above.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
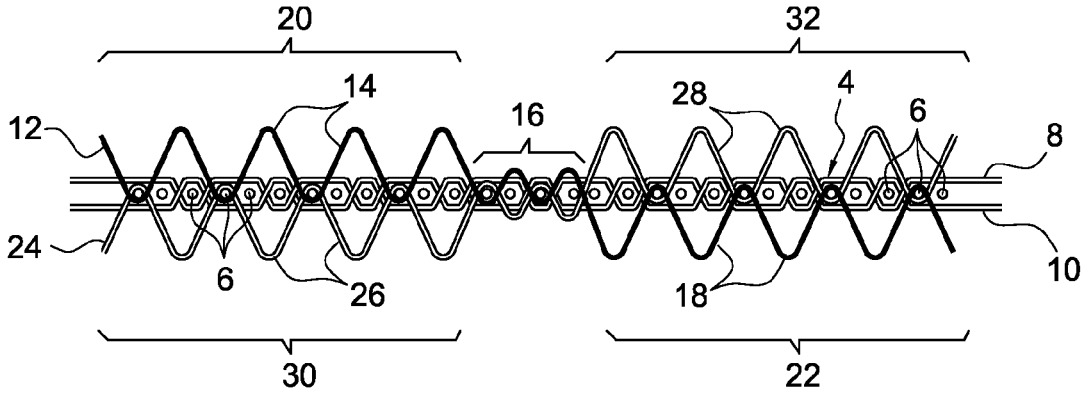
FIG. 1 is a sectional view of a fabric according to the invention.

Referring first to FIG. 1, there is shown a longitudinal cross section of the fabric 2 according to the invention. The fabric includes a support web 4 formed by a plurality of picks 6 across which two warp ends 8, 10 are woven. In the drawing, the warp ends are woven around every third pick, although alternate weaving patterns may be used as is known in the art to form the web. The array of picks and warp ends defines the web 4 which has top and bottom surfaces.

An additional warp 12 of hydrophilic material is interlaced in the support web to define a plurality of loops 14 which extend from the top surface of the web. However, the loops do not extend along the entire top surface. Rather, in a transition area 16 of the support web, the warp of hydrophilic material is tightly woven to avoid any elongated loops. Continuing longitudinally of the web, the warp 12 is interlaced to define loops 18 of hydrophilic material which extend from the bottom surface of the web. The loops 14 and 18 thus define first 20 and second 22 surface areas, respectively, of the fabric which are spaced longitudinally and on opposite sides of the web.

A warp 24 of hydrophobic material is interlaced in the support web to define a plurality of loops 26 which extend from the bottom surface of the web opposite the loops 14 of hydrophilic material. In the transition area 16 of the support web, the warp 24 is tightly woven to avoid any elongated loops. Continuing longitudinally of the web, the warp 24 is interlaced to define loops 28 of hydrophobic material which extend from the top surface of the web opposite the loops 18 of hydrophilic material. The loops 26 and 28 thus define third 30 and fourth 32 surface areas, respectively of the fabric which are spaced longitudinally and on opposite sides of the web.

Figure 2:
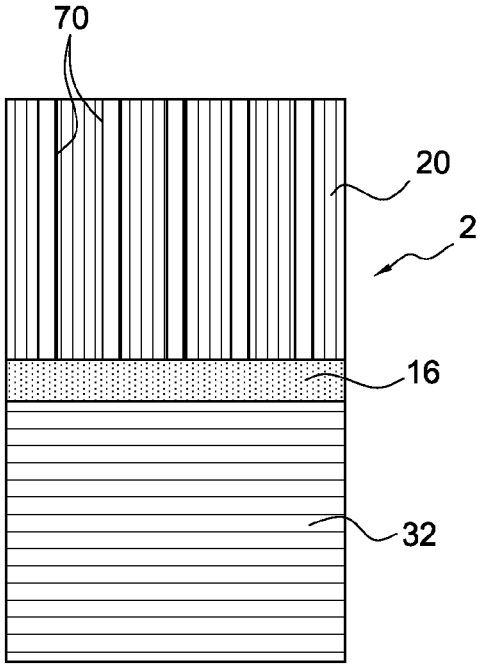
FIGS. 2 and 3 are front and rear plan views, respectively, of a towel formed from the fabric shown in FIG. 1.
Figure 3:
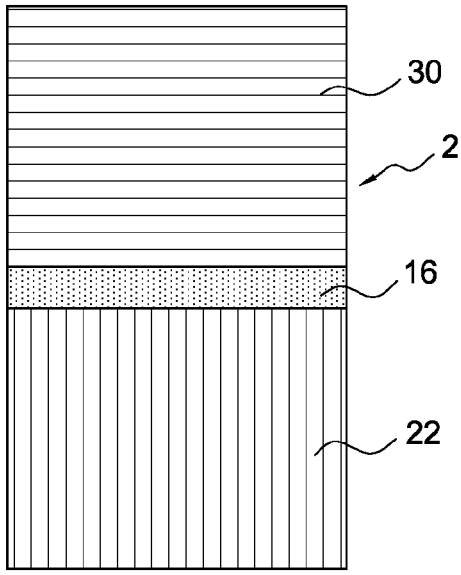

FIGS. 2 and 3 illustrate the opposite surfaces of the fabric showing the first 20, second 22, third 30 and fourth 32 surface areas relative to the transition area 16.

Hydrophilic materials absorb fluids while hydrophobic materials repel fluids. Suitable hydrophilic materials for the warp 12 are cellulosic or cotton materials. Suitable hydrophobic materials for the warp 24 are polyester, nylon, acrylic, or microfiber. By providing different materials for the warps and by weaving the warps into different areas on the surfaces of the support web, a fabric for making an article such as a towel or the like can be provided with surface portions having different characteristics to increase the use and versatility of the article as will be developed in greater detail below.

Figure 4:
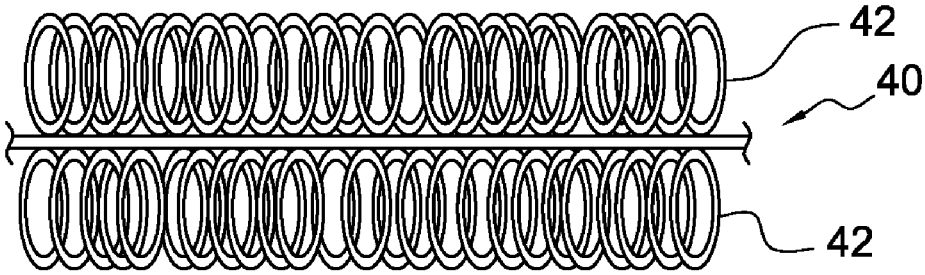
FIGS. 4, 5, and 6 show sectional views of different fabrics, respectively, according to the invention with terry and velour surfaces of the fabric.
Figure 5:
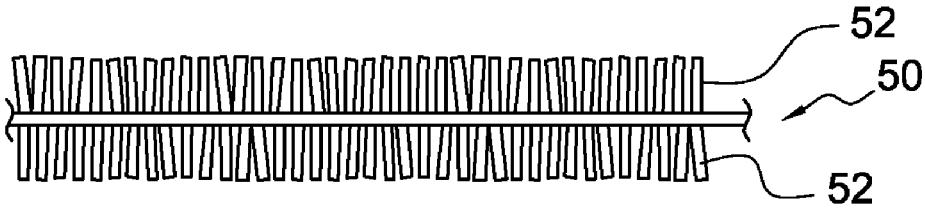
Figure 6:
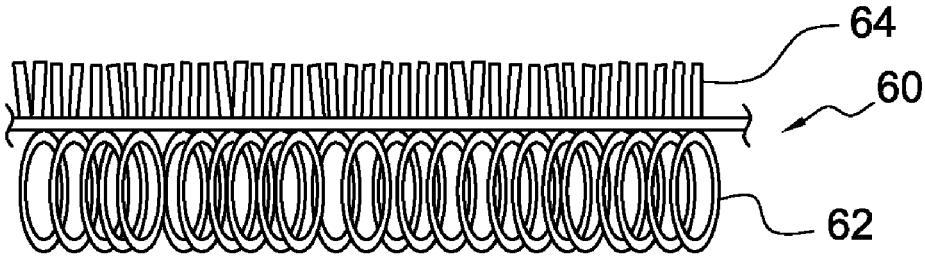

The surface texture of each area of the fabric is defined by the size and treatment of the loops. Referring to FIG. 4, there is shown a sectional view of a fabric 40 with loops 42 of the same size on opposite surfaces of the fabric. The uncut loops define a terry cloth surface which is suitable for moisture absorption or abrasive scrubbing. FIG. 5 shows a fabric 50 with loops 52 whose ends are cut so that the surfaces of the fabric have a velour finish which is typically softer than a terry finish and is suitable for buffing. In FIG. 6 is shown a fabric 60 having uncut loops 62 on one surface and cut loops 64 on the opposite surface to provide a fabric with different textures on either side.

The surface texture of the fabric can also be modified by providing loops of different length within a surface area. Referring to FIG. 2, the surface area 20 is formed with ribs 70 which are defined by providing alternating groups of short and long loops during weaving of the surface portion. A ribbed or otherwise sculptured fabric surface is suitable and desirable for scrubbing.

The appearance of the fabric can also be modified such as by dying the fabric. Because the hydrophobic material does not absorb fluids, when the fabric is passed through a bath of dye, only the hydrophilic material will absorb the dye. Thus, different surfaces of the fabric may be dyed.

It is also known in the art to provide images on a fabric surface, such by VTP Vapor Heat Transfer and/or Sublimation printing, pigment dye silk screen printing, wet process fiber reactive print, embroidery and/or applique.

Varying the size of the yarn used for the warp will alter the configuration of the fabric surface. Adjusting the yarn types or the amount of weft inserted yarns will affect the support web density and the amount of hydrophilic or hydrophobic yarns exposed to a source of moisture. This allows for various manufacturing possibilities for an article where abrasive surfaces can be made of one pick rate and an embellished face can be made of a different pick rate to produce different functional surfaces based on the density of the weft yarns in the support web.

Turning once again to FIGS. 2 and 3, a four surface fabric towel is provided wherein the first surface area 20 is formed of an absorbent cellulosic material which is woven or knitted with a ribbed construction for soft abrasive cleaning and drying action. It can be color coordinated with an embellishment on the third surface area 30. The area 30 comprises an embellishment face of relatively non-absorbent material using hydrophobic yarns. The embellishment can be provided via VTP Vapor Print Heat Transfer and/or sublimation printing, pigment dye silk screen printing, wet process fiber reactive printing, embroidery and/or applique. The second surface area 32 is a non-absorbent stain resistant and moisture wicking face which is woven or knitted using hydrophobic yarns. If desired, the face can be ribbed or otherwise sculptured (not shown) for aggressive abrasive cleaning action while wicking moisture to the cellulosic material on the surface 20 on the opposite side of the fabric. The fourth surface area 22 is a plain terry surface for non-linting drying and polishing for stainless steel or other high polishing painted surfaces. It may also be color coordinated with the surface area 32.

Although the preferred form of the invention provides four surfaces with two different materials provided on each surface, it will be readily apparent that alternate arrangements of the materials can be provided.

While the preferred forms and embodiments of the invention have been illustrated and described, it will be apparent to those of ordinary skill in the art that various changes and modifications may be made without deviating from the inventive concepts set forth above.

What is claimed is:

1. A woven pile fabric article, comprising (a) a support web comprising a plurality of picks and a plurality of warps crossly wrapped around at least one of said picks, said support web having top and bottom surfaces on opposite sides thereof;

(b) a hydrophilic material interlaced in said support web to define loops of hydrophilic material which extend from a first portion of said support web top surface to define a first surface area and loops of hydrophilic material which extend from a second portion of said support web bottom to define a second surface area, said first and second surface areas being longitudinally spaced from one another by a transition area;

(c) a hydrophobic material interlaced in said support web to define loops of hydrophobic material which extend from a third portion of said support web bottom surface to define a third surface area and loops of hydrophobic material which extend from a fourth portion of said support web top surface to define a fourth surface area, said third and fourth surface areas being longitudinally spaced from one another by said transition area, said first and third surface areas being continuous and arranged opposite to one another and said second and fourth surface areas being continuous and arranged opposite to one another to define four surface areas of the article.

2. An article as defined in claim 1, wherein said loops on at least one of said first, second, third, and fourth surface areas are sheared to define a velour fabric.

3. An article as defined in claim 1, wherein said hydrophobic material comprises one of a polyester, nylon, acrylic and microfiber yarn.

4. An article as defined in claim 3, wherein said hydrophilic material comprises one of a cellulosic and cotton yarn.

5. An article as defined in claim 1, wherein at least one of said third and fourth surface areas bears a decorative pattern.

6. An article as defined in claim 5, wherein said decorative pattern is applied to one of said third and fourth surface areas by one of printing and embellishment.

7. An article as defined in claim 6, wherein the other of said third and fourth portions has a sculptured construction.

8. An article as defined in claim 7, wherein at least one of said first and second surface areas has a sculptured construction.

* * * * *